US011758630B2

(12) United States Patent
Li

(10) Patent No.: US 11,758,630 B2
(45) Date of Patent: Sep. 12, 2023

(54) CONSTANT-CURRENT DRIVE CIRCUIT, CONSTANT-CURRENT DRIVE DEVICE AND LAMP

(71) Applicant: SHENZHEN SUNMOON MICROELECTRONICS CO., LTD., Guangdong (CN)

(72) Inventor: Zhaohua Li, Guangdong (CN)

(73) Assignee: SHENZHEN SUNMOON MICROELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 17/855,684

(22) Filed: Jun. 30, 2022

(65) Prior Publication Data

US 2023/0035483 A1 Feb. 2, 2023

(30) Foreign Application Priority Data

Jul. 29, 2021 (CN) ..... 202110862330.1

(51) Int. Cl.
*H05B 45/345* (2020.01)

(52) U.S. Cl.
CPC ..... *H05B 45/345* (2020.01)

(58) Field of Classification Search
CPC ..... H05B 45/10; H05B 45/30; H05B 45/34; H05B 45/345; H05B 47/10; H05B 47/25
See application file for complete search history.

(56) References Cited

U.S. PATENT DOCUMENTS

2016/0268907 A1* 9/2016 Chen ..... H02M 3/33507
2018/0287479 A1* 10/2018 Li ..... H02M 3/33523

* cited by examiner

*Primary Examiner* — Jimmy T Vu
(74) *Attorney, Agent, or Firm* — CANTOR COLBURN LLP

(57) ABSTRACT

This application provides a constant-current drive circuit. First, the voltage at the input end is collected through peak-voltage sample and hold module to generate the input-voltage sampling signal, and the hold voltage at the current moment is obtained by calculating an average of the peak voltage of the input-voltage sampling signal and the hold voltage at the previous moment, and output as the output voltage signal to the voltage-controlled current source module. Then, a corresponding current signal is generated through the voltage-controlled current source module according to the output voltage signal and the preset second threshold voltage, and a mirror operation is performed on the current signal through the constant-current threshold control module to generate the mirrored current signal, and according to the mirrored current signal, the constant-current threshold is adjusted, so as to maintain the operation current flowing through the load a constant-current.

17 Claims, 5 Drawing Sheets

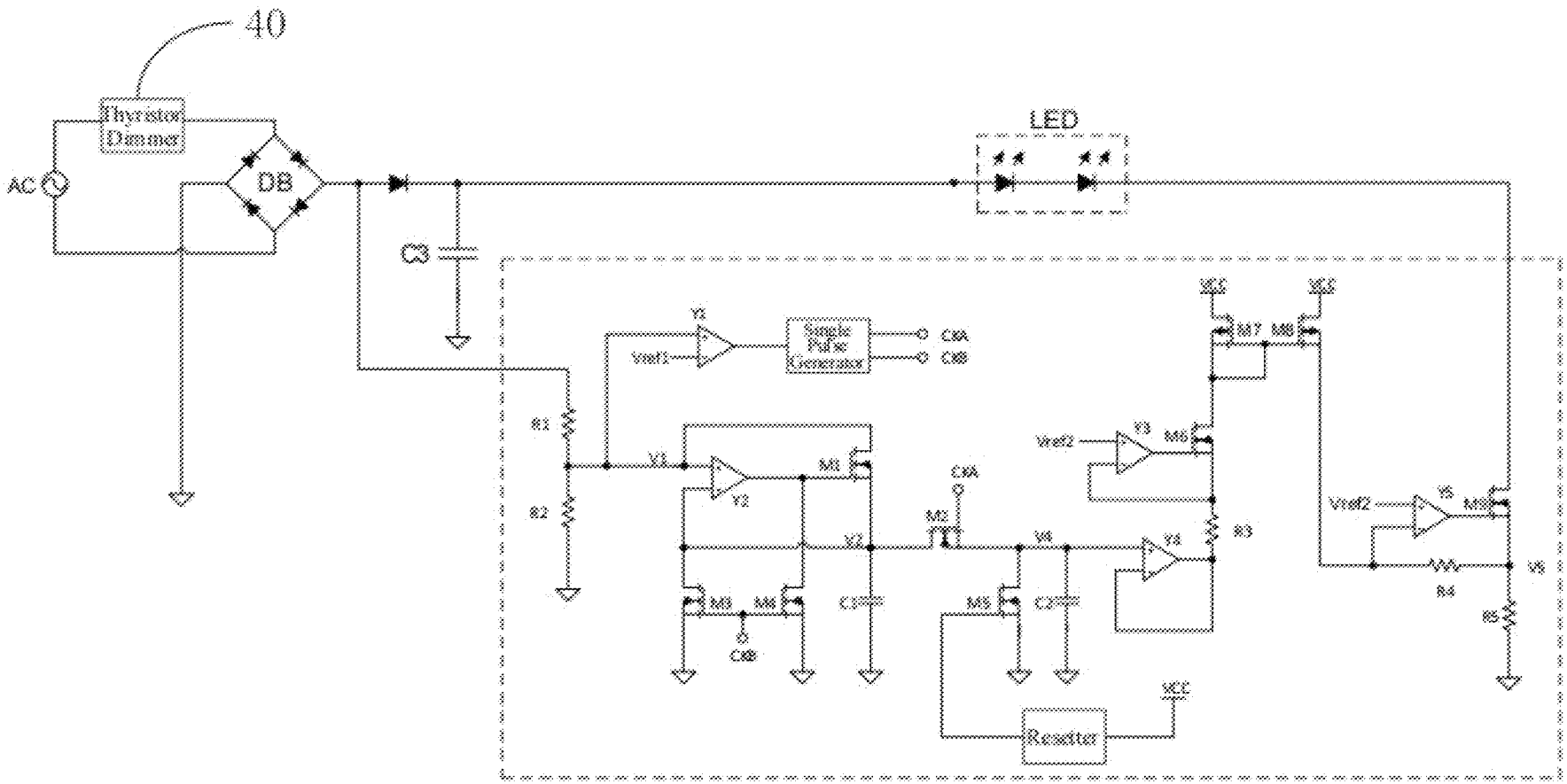
40
AC
Inverter Dimmer
DB
C3
LED
Vref1
Vref2
Vref3
Vref4
Trigger Pulse Generator
Resistor
Comp
CS
CS
CS

CONSTANT-CURRENT DRIVE CIRCUIT, CONSTANT-CURRENT DRIVE DEVICE AND LAMP

CROSS-REFERENCE TO RELATED APPLICATION

Pursuant to 35 U.S.C. § 119 and the Paris Convention, this application claims the benefit of Chinese Patent Application No. 202110862330.1 filed Jul. 29, 2021, the content of which is incorporated herein by reference.

TECHNICAL FIELD

The present application relates to the field of electronic technologies, and in particular, to a constant-current drive circuit, a constant-current drive device and a lamp.

BACKGROUND

In a constant-current (CC) system powered by mains, the input voltage of the constant-current drive circuit is the rectified and filtered mains voltage minus the on-voltage of the LED light string. When the mains voltage fluctuates, the input voltage of the constant-current drive circuit will be lower than a constant-current threshold of the constant-current drive circuit, resulting in ripples in the current flowing through the LED light string, making the entire LED system flicker, the stroboscopic index exceed the standard and other problems.

SUMMARY

In view of the above, embodiments of the present application provide a constant-current drive circuit, a constant-current drive device and a lamp, in which, the constant-current threshold can be adaptively controlled when the input voltage fluctuates, and the current ripple caused by the input voltage fluctuation can be effectively reduced, thereby solving the problems of flicker and stroboscopic index exceeding the standard caused when the input voltage of the constant-current drive circuit is lower than the constant-current threshold of the constant-current drive circuit.

In accordance with an embodiment of the present application, a constant-current drive circuit is provided. The constant-current drive circuit includes: a peak-voltage sample and hold module, a voltage-controlled current source module and a constant-current threshold control module. The peak-voltage sample and hold module is configured to collect a voltage at an input end to generate an input-voltage sampling signal, and obtain, according to an average of a peak voltage of the input-voltage sampling signal and a hold voltage at a previous moment, a hold voltage at a current moment as a voltage value of an output voltage signal. The voltage-controlled current source module is connected to the peak-voltage sample and hold module, and configured to receive the output voltage signal, and generate a current signal according to the output voltage signal and a preset second threshold voltage. The constant-current threshold control module is connected to the voltage-controlled current source module, and configured to mirror the current signal according to a proportional coefficient to generate a mirrored current signal, and adjust the constant-current threshold according to the mirrored current signal, so as to maintain an operation current flowing through a load a constant current.

In an embodiment, the peak voltage sample and hold module includes: an input-voltage sampling unit, a single-pulse generating unit, and a sample-voltage averaging unit.

The input-voltage sampling unit is configured to sample a voltage signal at the input end to generate the input-voltage sampling signal. The single-pulse generating unit is connected to the input-voltage sampling unit, and is configured to generate a first serial single-pulse signal and a second serial single-pulse signal when a voltage value of the input-voltage sampling signal is greater than a first threshold voltage. The second serial single-pulse signal is generated after the first serial single-pulse signal.

The sample-voltage averaging unit is connected to the input-voltage sampling unit and the single-pulse generating unit, and is configured to collect the peak voltage of the input-voltage sampling signal. During a duration of the first serial single-pulse signal, the hold voltage at the previous moment and the peak voltage are averaged to update the hold voltage at the current moment as the voltage value of the output voltage signal.

In an embodiment, the input-voltage sampling unit includes: a first resistor and a second resistor. A first end of the first resistor is connected to the input end, a second end of the first resistor and a first end of the second resistor are connected in common to the peak voltage sampling unit, and a second end of the second resistor is grounded.

In an embodiment, the single-pulse generating unit includes: a single pulse generator and a first operational amplifier. A non-inverting input end of the first operational amplifier is connected to the input-voltage sampling unit. An inverting input end of the first operational amplifier is connectable to a first threshold voltage source. An output end of the first operational amplifier is connected to the single pulse generator. A first output end and a second output end of the single pulse generator are both connected to the sample-voltage averaging unit.

In an embodiment, the sample-voltage averaging unit is also configured to collect an average voltage of the input-voltage sampling signal, and update the average voltage of the current input-voltage sampling signal to the hold voltage at the current moment, or update the peak voltage of the current input-voltage sampling signal to the hold voltage at the current moment.

In an embodiment, the sample-voltage averaging unit includes: a second operational amplifier, a first switch, a first capacitor, a second switch, a third switch, a fourth switch, a fifth switch, a second switch capacitor and resetter. A non-inverting input end of the second operational amplifier and a first end of the first switch are connected in common to the input-voltage sampling unit. An inverting input end of the second operational amplifier and a second end of the first switch, a first end of the first capacitor, a first end of the second switch and a first end of the third switch are connected in common. A second end of the first capacitor is grounded. An output end of the second operational amplifier, a control end of the first switch and a first end of the fourth switch are connected in common. A control end of the second switch is connected to a first output end of the single-pulse generating unit. A second end of the third switch is grounded. A control end of the third switch and a control end of the fourth switch are connected in common and connectable to a second output end of the single-pulse generating unit. A second end of the fourth switch is grounded. A second end of the second switch, a first end of the fifth switch, and a first end of the second capacitor are connected in common to the voltage-controlled current source module. A second end of the second capacitor is grounded. A second end of the fifth switch is grounded, and a control end of the fifth switch is connected to the resetter.

In an embodiment, the voltage-controlled current source module includes: a third operational amplifier, a fourth operational amplifier, a sixth switch, and a third resistor.

A first end of the sixth switch is connected to the constant-current threshold control module. A non-inverting input end of the third operational amplifier is connectable to a second threshold voltage source. An inverting input end of the third operational amplifier, a second end of the sixth switch and a first end of the third resistor are connected in common. A control end of the sixth switch is connected to an output end of the third operational amplifier. A non-inverting input end of the fourth operational amplifier is connected to the peak-voltage sample and hold module. An inverting input end of the fourth operational amplifier and an output end of the fourth operational amplifier are connected in common to a second end of the third resistor.

In an embodiment, the constant-current threshold control module includes: a current mirror unit and an operation-current adjustment unit. The current mirror unit is connected to the voltage-controlled current source module, and is configured to perform a mirror amplification on the current signal to generate a mirrored current signal. The operation-current adjustment unit is connected to the current mirroring unit, and is configured to adjust the constant-current threshold according to the mirrored current signal, so as to maintain the operation current flowing through the load a constant current.

In accordance with an embodiment of the present application, a constant-current drive device is also provided, which includes the constant-current drive circuit described in any one of the above embodiments.

In accordance with an embodiment of the present application, a lamp is further provided. The lamp includes: a light source load; and the constant-current drive circuit according to any one of the above embodiments. The constant-current drive circuit is connected to the light source load.

Embodiments of the present application provide a constant-current drive circuit, a constant-current drive device, and a lamp. The constant-current drive circuit includes: a peak-voltage sample and hold module, a voltage-controlled current source module, and a constant-current threshold control module. First, the voltage at the input end is collected through peak-voltage sample and hold module to generate the input-voltage sampling signal, and the hold voltage at the current moment is obtained by calculating an average of the peak voltage of the input-voltage sampling signal and the hold voltage at the previous moment, and the hold voltage at the current moment is output as the output voltage signal to the voltage-controlled current source module, where the initial value of the hold voltage is 0. Then, a corresponding current signal is generated through the voltage-controlled current source module according to the output voltage signal and the preset second threshold voltage, and a mirror operation is performed on the current signal through the constant-current threshold control module to generate the mirrored current signal, and according to the mirrored current signal, the constant-current threshold is adjusted, so as to maintain the operation current flowing through the load a constant-current. In this way, the constant-current threshold can be adaptively controlled when the input voltage fluctuates, and the current ripple caused by the input voltage fluctuation can be effectively reduced.

BRIEF DESCRIPTION OF THE DRAWINGS

In order to illustrate the solutions in the embodiments of the present application more clearly, the following will briefly introduce the drawings that need to be used in the description of the embodiments or the prior art. Obviously, the following drawings are merely some embodiments of the present application. For those of ordinary skill in the art, other drawings can also be obtained according to these drawings in the absence of creative labor.

FIG. 6 is an application schematic diagram of another constant-current drive circuit in accordance with an embodiment of the present application.

DETAILED DESCRIPTION OF THE EMBODIMENTS

In order to make those skilled in the art better understand the solutions of the present application, the embodiments of the present application will be clearly described below with reference to the drawings. Obviously, the embodiments described herein are merely some embodiments, not all embodiments of the present application. Other embodiments obtained by those of ordinary skill in the art based on the following embodiments without creative labor shall fall within the protection scope of the present application.

The term "comprise/include" and any variations thereof in the description and claims of this application and the above-mentioned drawings are intended to cover the non-exclusive inclusion. For example, a process, a method or system, a product or device including/comprising a series of steps or units is not limited to the steps or units as listed, but optionally also includes unlisted steps or units, or optionally also includes other steps or units inherent in the process, the method, the product or the device. Also, the terms "first," "second," and "third," etc. are used to distinguish between different objects, rather than to describe a particular order.

Figure 1:
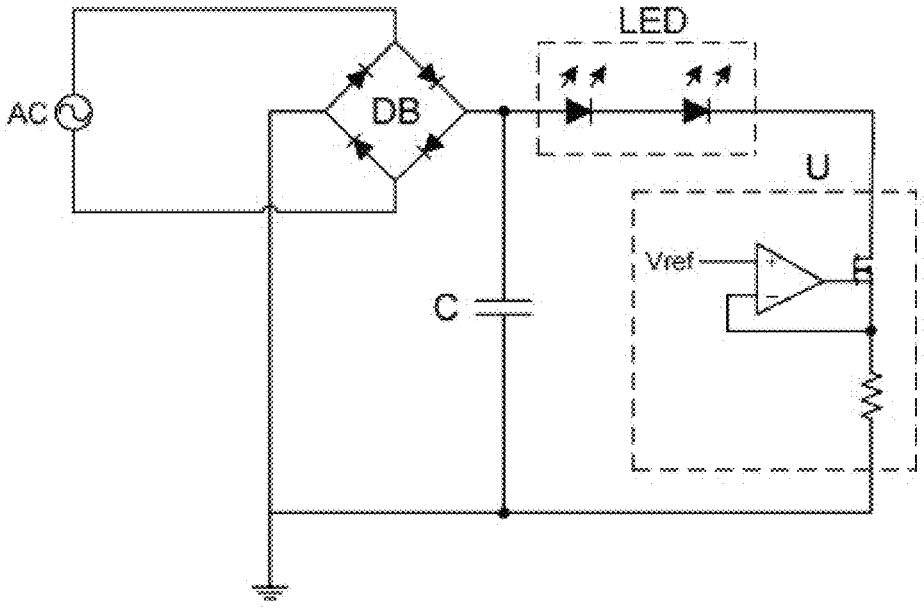
FIG. 1 is a schematic structural diagram of a traditional LED constant-current system.
Figure 2:
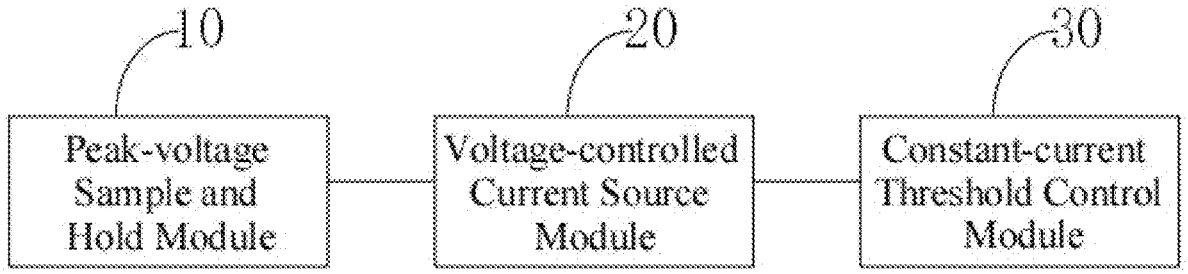
FIG. 2 is a schematic structural diagram of a constant-current drive circuit in accordance with an embodiment of the present application.

In order to solve the above problems, an embodiment of the present application provides a constant-current drive circuit, as shown in FIG. 2, the constant-current drive circuit is connectable to a load, and the constant-current drive circuit includes: a peak-voltage sample and hold module 10, a voltage-controlled current source module 20, and a constant-current threshold control module 30.

Specifically, the peak-voltage sample and hold module 10 is configured to collect a voltage at the input end to generate an input-voltage sampling signal, and obtain a hold voltage at a current moment according to an average of a peak voltage of the input-voltage sampling signal and a hold voltage at a previous moment, and output the hold voltage at the current moment as an output voltage signal to the voltage-controlled current source module. In a specific application, an initial value of the hold voltage is a preset reference voltage, and the preset reference voltage is 0, that is, at the startup time, the hold voltage is 0, and when the average voltage value is calculated, the hold voltage at the previous moment is 0 V.

The voltage-controlled current source module 20 is connected to the peak-voltage sample and hold module 10, and the voltage-controlled current source module 20 is configured to generate a current signal according to the output voltage signal and a preset second threshold voltage. The constant-current threshold control module 30 is connected to the voltage-controlled current source module 20 and the load, and the constant-current threshold control module 30 is configured to mirror the current signal to generate a mirrored current signal, and adjust the constant-current threshold according to the mirrored current signal, so as to maintain an operation current flowing through the load a constant current, such that the constant-current threshold can be adaptively controlled when the input voltage fluctuates, and the current ripple caused by the input voltage fluctuation can be effectively reduced.

In this embodiment, in order to realize the adaptive adjustment of the constant-current threshold of the constant-current drive circuit, first, through the peak-voltage sample and hold module 10, the hold voltage at the current moment is obtained by calculating an average of the peak voltage of the input-voltage sampling signal and the hold voltage at the previous moment, and output as the output voltage signal to the voltage-controlled current source module. Then, a corresponding current signal is generated through the voltage-controlled current source module 20 according to the output voltage signal and the preset second threshold voltage, a mirror operation is performed on the current signal through the constant-current threshold control module 30 to generate a mirrored current signal, and according to the mirrored current signal, the constant-current threshold is adjusted to maintain the operation current flowing through the load a constant current. In this way, the constant-current threshold can be adaptively controlled when the input voltage fluctuates, and the current ripple caused by the input voltage fluctuation can be effectively reduced.

In a specific application embodiment, the input end of the peak-voltage sample and hold module 10 receives an externally input voltage signal, and an output end of the peak-voltage sample and hold module 10 is connected to the voltage-controlled current source module 20. The peak-voltage sample and hold module 10 is configured to sample the current peak voltage of the externally input voltage signal in real-time and buffer the voltage at the previous moment, and then obtain the average value of the peak voltage and the voltage at the previous moment, update the average value to the voltage value at the current moment, and output the same as an output voltage signal to the voltage-controlled current source module 20.

One end of the voltage-controlled current source module 20 is connected to the peak-voltage sample and hold module 10, and the other end is connected to the constant-current threshold control module 30.

The constant-current threshold control module 30 performs a mirror amplification on the current signal according to a certain proportional coefficient K, and adjusts the constant-current threshold according to the mirrored current signal obtained by the mirror amplification, so as to maintain the operation current flowing through the load a constant current.

Figure 3:
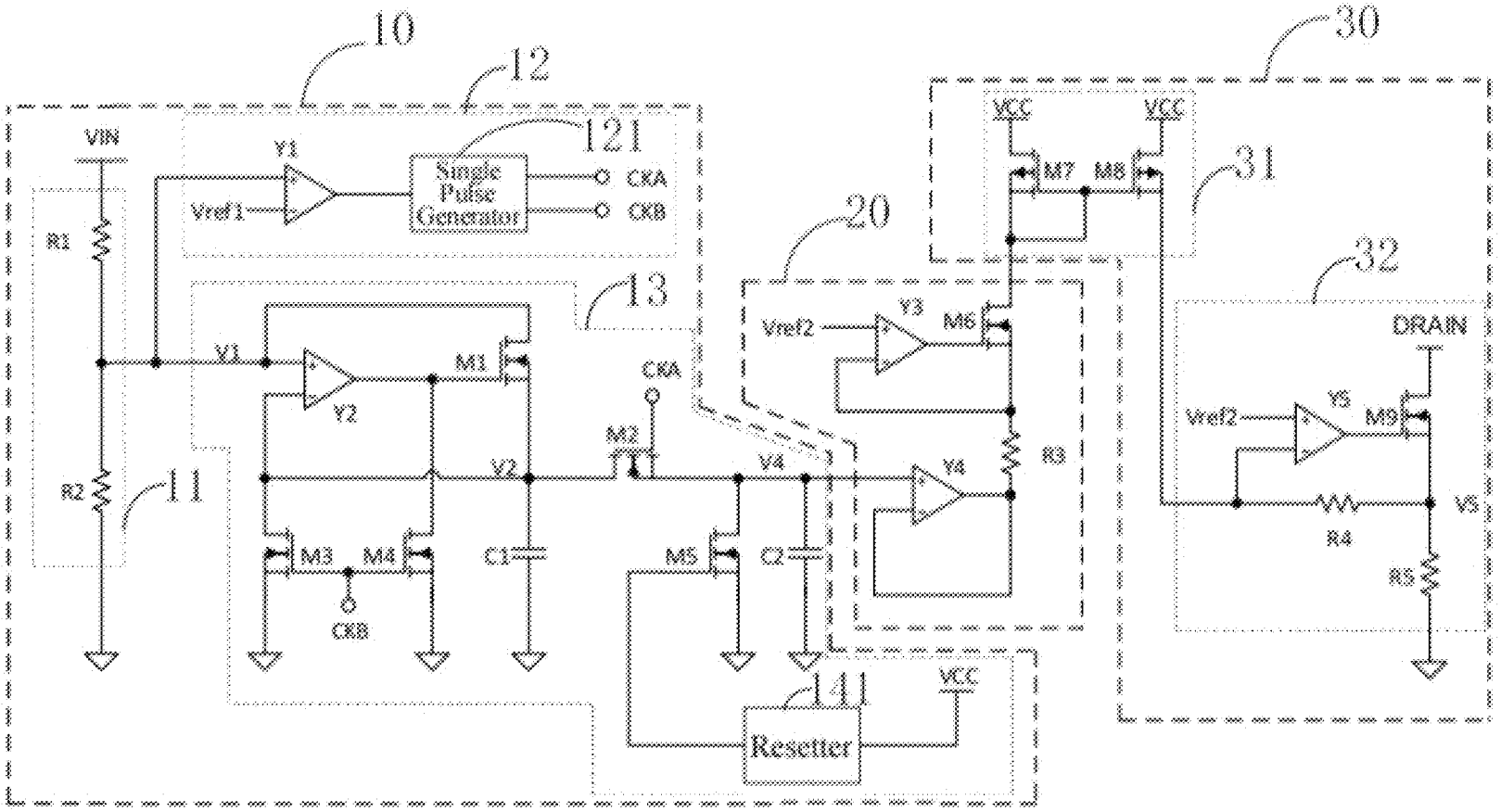
FIG. 3 is a circuit schematic diagram of a constant-current drive circuit in accordance with an embodiment of the present application.

In an embodiment, as shown in FIG. 3, the peak-voltage sample and hold module 10 includes: an input-voltage sampling unit 11, a single-pulse generating unit 12 and a sample-voltage averaging unit 13. The input-voltage sampling unit 11 is configured to sample the voltage signal at the input end to generate an input-voltage sampling signal. The single-pulse generating unit 12 is connected to the input-voltage sampling unit 11, and is configured to generate a first serial single-pulse signal and a second serial single-pulse signal when the voltage value of the input-voltage sampling signal is greater than the first threshold voltage. The second serial single-pulse signal is generated after the first serial single-pulse signal.

The sample-voltage averaging unit 13 is in connection with the input-voltage sampling unit 11 and the single-pulse generating unit 12, and the sample-voltage averaging unit 13 is configured to receive the input-voltage sampling signal and collect the peak voltage of the input-voltage sampling signal; and store the voltage value of the input-voltage sampling signal at the previous moment according to the first serial single-pulse signal and the second serial single-pulse signal, and determine the average voltage of the input-voltage sampling signal and the input-voltage sampling signal at the previous moment to generate the output voltage signal.

In this embodiment, two serial single-pulse signals are generated by the single-pulse generating unit 12 with a delay after power-on, and a charge-and-discharge adjustment is performed by the sample-voltage averaging unit 13 on the collected voltage signals according to the two serial single-pulse signals, to determine the peak voltage of the input-voltage sampling signal. During a duration of the first serial single-pulse signal, the hold voltage at the previous moment is averaged with the peak voltage, and the averaged voltage is updated to the hold voltage at the current moment, as the voltage value of the output voltage signal.

In an embodiment, as shown in FIG. 3, the input-voltage sampling unit 11 includes: a first resistor R1 and a second resistor R2. A first end of the first resistor R1 is connected to the input end. A second end of the first resistor R1 and a first end of the second resistor R2 is connected in common to the sample-voltage averaging unit 13. A second end of the second resistor R2 is grounded.

In this embodiment, the first resistor R1 and the second resistor R2 constitute a voltage divider circuit, and the voltage at the input end is divided by the voltage divider circuit to generate an input-voltage sampling signal.

In an embodiment, as shown in FIG. 3, the single-pulse generating unit 12 includes: a single pulse generator 121 and a first operational amplifier Y1. A non-inverting input end of the first operational amplifier Y1 is connected to the voltage sampling unit, an inverting input end of the first operational amplifier Y1 is connected to the first threshold voltage source, and an output end of the first operational amplifier Y1 is connected to the single-pulse signal amplifier. Both a first output end and a second output end of single pulse generator 121 are connected to the sample-voltage averaging unit 13.

In a single half-wave cycle of the mains, when the voltage V1 is greater than the voltage Vref1 at the inverting input end of the first operational amplifier Y1, the two serial single-pulse signals, namely, the first serial single-pulse signal CKA and the second serial single-pulse signal CKB will generated by the single pulse generator 121 with a delay. The second serial single-pulse signal CKB is generated after the first serial single-pulse signal CKA ends for a period of time.

In an embodiment, the sample-voltage averaging unit 13 includes: a second operational amplifier Y2, a first switch M1, a first capacitor C1, a second switch M2, a third switch M3, a fourth switch M4, a fifth switch M4, and a fifth switch M5, a second capacitor C2 and a resetter (i.e., a power on reset) 141.

A non-inverting input end of the second operational amplifier Y2 and a first end of the first switch M1 are connected in common to the input-voltage sampling unit 11. An inverting input end of the second operational amplifier Y2, a second end of the first switch M1 and a first end of a capacitor C1 are connected in common to a first end of the second switch M2. A second end of the first capacitor C1 is grounded. An output end of the second operational amplifier Y2 and a control end of the first switch M1 are connected in common to a first end of the fourth switch.

A control end of the second switch M2 is connected to the single-pulse generating unit 12, a first end of the second switch M2 and a first end of the third switch M3 are connected in common, and a second end of the third switch M3 is grounded. A control end of the third switch M3 and the control end of the fourth switch M4 are connected in common to the single-pulse generating unit 12. A second end of the fourth switch M4 is grounded. A second end of the second switch M2, a first end of the fifth switch M5, and a first end of the second capacitor C2 are connected in common to the voltage-controlled current source module 20. A second end of the second capacitor C2 is grounded, a second end of the fifth switch M5 is grounded, and a control end of the fifth switch M5 is connected to the resetter 141.

In this embodiment, the second operational amplifier Y2, the first switch M1 and the first capacitor C1 constitute a peak-voltage sampling circuit. The voltage value of the input-voltage sampling signal is set to V1, and the voltage at the common end of the first switch M1 and the first capacitor C1 is V2. The first switch M1 switches on when the voltage V2 is less than the voltage V1, and the first capacitor C1 continues to be charged until the voltage V2 on the first capacitor C1 is larger than or equal to the voltage V1, the first switch M1 switches off, and the charging loop for V2 is off, at this time the voltage V2 is the peak voltage of V1.

In an embodiment, the first switch M1, the second switch M2, the third switch M3, the fourth switch M4 and the fifth switch M5 may be N-type MOS transistors.

The first serial single-pulse signal CKA is output to the control end of the second switch M2, the second serial single-pulse signal CKB is output to the common control end of the third switch M3 and the fourth switch M4. The first serial single-pulse signal CKA enables the second switch M2 to be switched on, at this time, the voltage V2 and the voltage V4 at the first end of the second capacitor C2 are averaged, and the second serial single-pulse signal CKB enables the third switch M3 and the fourth switch M4 to be switched on, so that the voltage V2 is discharged to zero, and the first switch M1 is switched off.

In a specific application, the averaged voltage is updated to the voltage at the current moment as the voltage value of the output voltage signal, and meanwhile, the voltage at the current moment is transmitted to the voltage-controlled current source module 20. The average value is obtained, for example, according to the formula (((1+0)/2+2)/2)+3)/2 in form of accumulative average calculation, and output via the output voltage signal to the voltage-controlled current source module 20, so as to adaptively control the constant-current threshold when the input voltage fluctuates, and thus the current ripple caused by input voltage fluctuations can be effectively reduced.

In an embodiment, the sample-voltage averaging unit 13 is also configured to collect the average voltage of the input-voltage sampling signal, and update the current average voltage of the input-voltage sampling signal to the hold voltage at the current moment.

In this embodiment, by the sample-voltage averaging unit 13, the charge-and-discharge adjustment is performed on the collected voltage signal according to the two serial single-pulse signals to determine the average voltage of the input-voltage sampling signal, and to control the average processing process of voltage V2 and voltage V4, such as the switch-on or switch-off of the second switch M2 is controlled through the first serial single-pulse signal CKA, and the switch-on or switch-off of the third switch M3 and the fourth switch M4 are controlled through the second serial single-pulse signal CKB, so as to realize the voltage collection of input-voltage sampling signal.

Specifically, the second operational amplifier Y2, the first switch M1, and the first capacitor C1 constitute a voltage sampling circuit, the voltage value of the input-voltage sampling signal is set to V1, and the voltage at the common end of the first switch M1 and the first capacitor C1 is V2. The first switch M1 is switched on, when the voltage V2 is less than the voltage V1, and the first capacitor C1 continues to be charged until the voltage V2 on the first capacitor C1 is larger than or equal to the voltage V1, the first switch M1 is switched off, and the charging loop for V2 is closed, at this time the voltage V2 is the peak voltage of V1.

In an embodiment, the sample-voltage averaging unit 13 is also configured to update the peak voltage of the current input-voltage sampling signal to the hold voltage at the current moment.

In this embodiment, by the sample-voltage averaging unit 13, the charge-and-discharge adjustment is performed on the collected voltage signal according to the two serial single-pulse signals. The switch-on or switch-off of the second switch M2 is controlled through the first serial single-pulse signal CKA. The switch-on or switch-off of the third switch M3 and the fourth switch M4 is controlled through the second serial single-pulse signal CKB. The peak voltage of the input-voltage sampling signal is directly updated to the hold voltage at the current moment.

In an embodiment, the voltage-controlled current source module 20 includes: a third operational amplifier Y3, a fourth operational amplifier Y4, a sixth switch M6 and a third resistor R3. A first end of the sixth switch M6 is connected to the constant-current threshold control module 30. A non-inverting input end of the third operational amplifier Y3 is connected to a second threshold voltage source. An inverting input end of the third operational amplifier Y3, a second end of the sixth switch M6 and a first end of the third resistor R3 are connected in common. A control end of the sixth switch M6 is connected to an output end of the third operational amplifier Y3. A non-inverting input end of the fourth operational amplifier Y4 is connected to the peak-voltage sample and hold module 10. An inverting input end of the fourth operational amplifier Y4, an output end of the fourth operational amplifier Y4 is connected in common to a second end of the third resistor R3.

In this embodiment, the third operational amplifier Y3, the fourth operational amplifier Y4, the sixth switch M6 and the third resistor R3 constitute a voltage-controlled current source, so as to provide a current signal for the constant-current threshold control module 30. The non-inverting input end of the third operational amplifier Y3 is connected to the second threshold voltage source, and the voltage at the non-inverting input end of the third operational amplifier Y3 is Vref2. The non-inverting input end of the fourth operational amplifier Y4 is connected to the peak-voltage sample and hold module 10, and the voltage value at the non-inverting input end of the fourth operational amplifier Y4 is V4. As the resistance of the third resistor R3 is much larger than the on-resistance of the sixth switch M6, the current flowing through the sixth switch M6 is I1=(Vref2−V4)/R3, where Vref2 is the value of the second threshold voltage provided by the second threshold voltage source, and V4 is the voltage value of the output voltage signal generated by the peak-voltage sample and hold module 10.

In an embodiment, as shown in FIG. 3, the constant-current threshold control module 30 includes: a current mirror unit 31 and an operation-current adjustment unit 32. The current mirror unit 31 is in connection with the voltage-controlled current source module 20 and is configured to mirror a current signal to generate a mirrored current signal. The operation-current adjustment unit 32 is in connection with the current mirror unit 31 and the load, and is configured to adjust the constant-current threshold according to the mirrored current signal, so as to maintain the operation current flowing through the load a constant current.

In this embodiment, as shown in FIG. 3, the seventh switch M7 and the eighth switch M8 constitute a current mirror circuit. The current flowing through the eighth switch M8 is I2=K*I1, where the proportional coefficient K is determined by a size ratio of the seventh switch M7 and the eighth switch M8.

In an embodiment, as shown in FIG. 3, the operation-current adjustment unit 32 includes: a fifth operational amplifier Y5, a ninth switch M9, a fourth resistor R4 and a fifth resistor R5.

Specifically, a non-inverting input end of the fifth operational amplifier Y5 is connected to a second threshold voltage source, an inverting input end of the fifth operational amplifier Y5 and a first end of the fourth resistor R4 are connected in common to the current mirror unit 31. An output end of the amplifier Y5 is connected to a control end of the ninth switch M9. A first end DRAIN of the ninth switch M9 is connected to the load. A second end of the ninth switch M9, a second end of the fourth resistor R4 and a first end of the fifth resistor R5 are connected in common, and a second end of the fifth resistor R5 is grounded.

In an embodiment, the ninth switch M9 may be an N-type MOS transistor.

In this embodiment, the fourth resistor R4 is connected in series with the eighth switch M8, and the current flowing through the fourth resistor R4 is also I2, so the voltage at the common end of the second end of the ninth switch M9, the second end of the fourth resistor R4 and the first end of the fifth resistor R5 is V5=Vref2−I2*R4, and therefore, the current flowing through the load and the ninth switch M9 is:

$$I3 = \frac{Vref2 - I2 * R4}{R5} = \frac{(R3 - K * R4) * Vref2 + K * R4 * V4}{R3 * R5}$$

Figure 4:
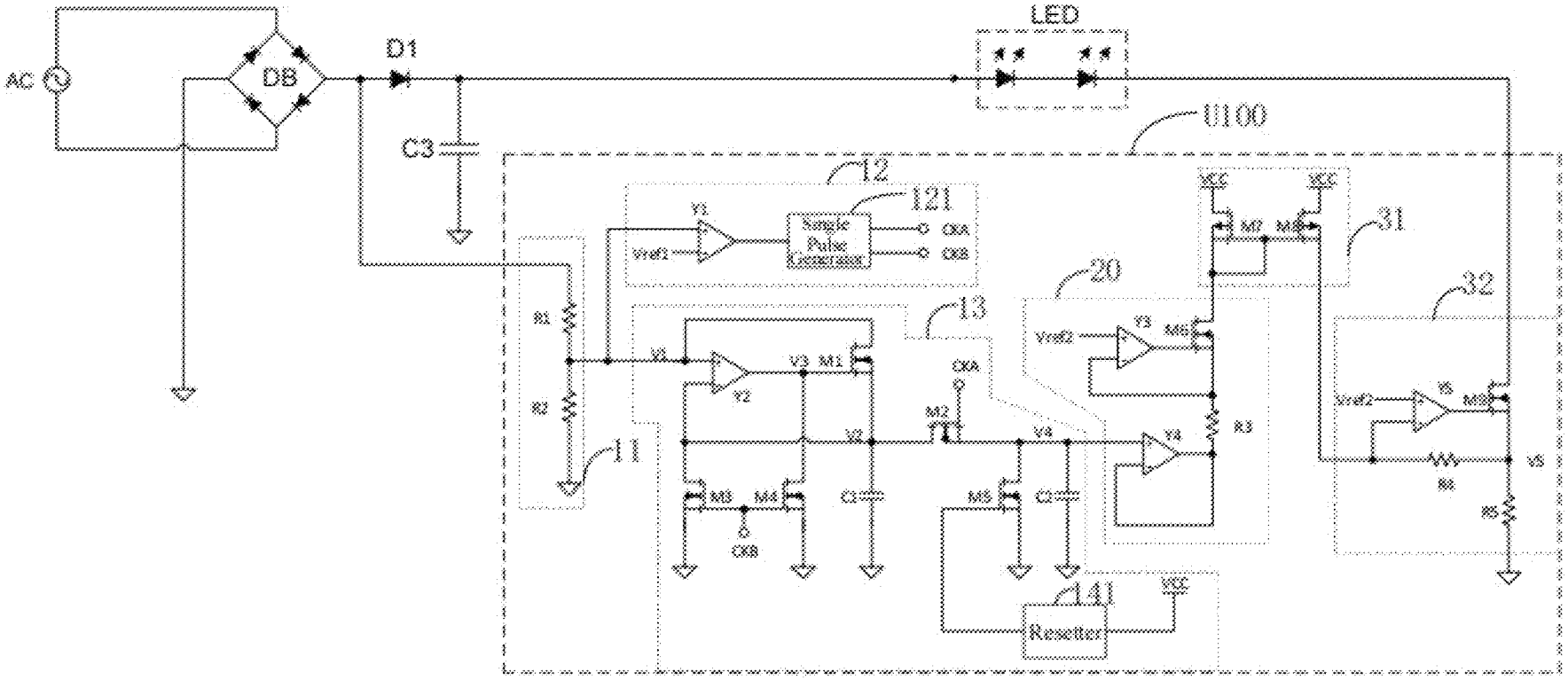
FIG. 4 is an application schematic diagram of a constant-current drive circuit in accordance with an embodiment of the present application.

FIG. 4 is an application schematic diagram the constant-current drive circuit which is applied to the LED constant-current system. Referring to FIG. 4, the load may be an LED light string. The first end of the ninth switch M9 is connected to the current output end of the LED light string. The input end of the peak-voltage sample and hold module 10 is connected to an output end of a rectifier bridge DB. The DC power output from the rectifier bridge DB, after a process of the first diode D1 and the third capacitor C3, is output to the LED light string.

Figure 5:
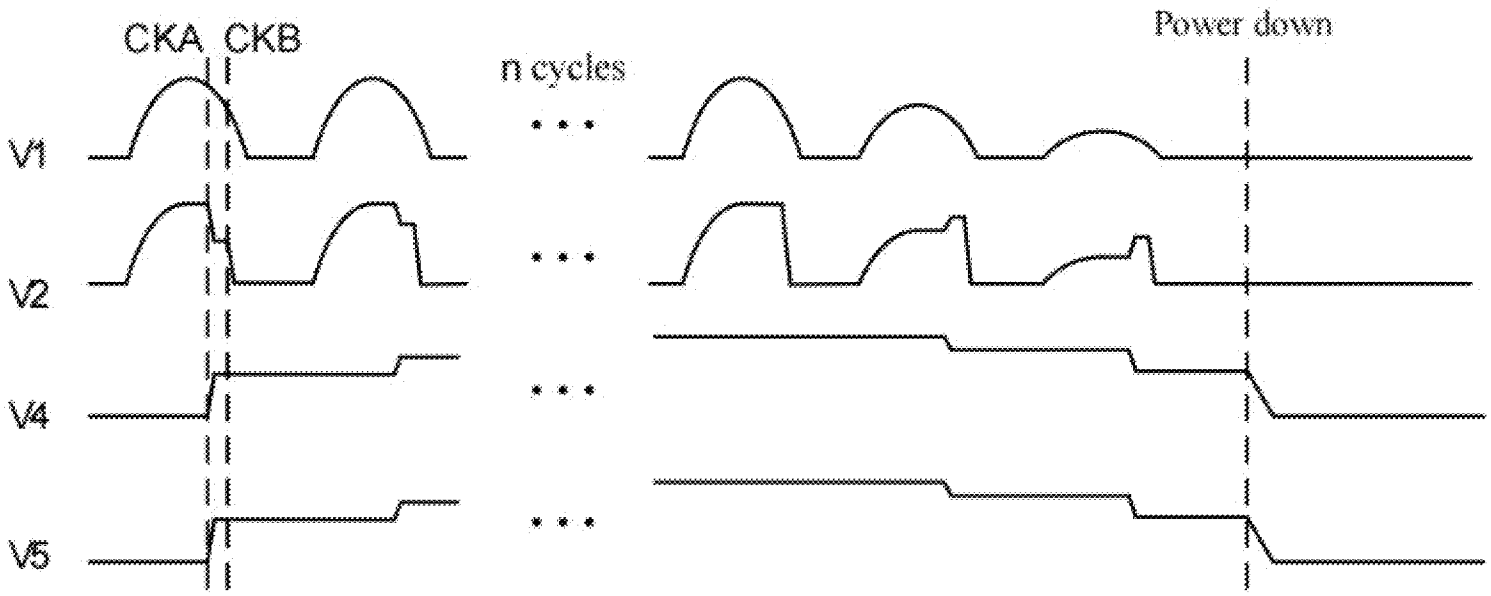
FIG. 5 is a schematic diagram of a voltage variation in accordance with an embodiment of the present application.

FIG. 5 shows a schematic diagram of the voltage variations of V1, V2, V4, and V5 in several cycles. With reference to FIGS. 4 and 5, at the initial power-on state, the voltage of V4 is zero, and after a few cycles, V4 reaches the voltage of V2, i.e., the peak voltage of V1, when the mains voltage decreases, the peak value of V1 decreases, resulting in a decrease in the voltage of V4, hence, the current flowing through the LED and the ninth switch M9 is reduced. Since the current flowing through the ninth switch M9 decreases, the constant-current threshold of the nine switch M9 will also decrease accordingly, so that the current flowing through the load can still maintain a constant current.

Referring to FIG. 6, between the rectifier bridge and the mains power supply AC, a thyristor dimmer 40 is added, the constant-current threshold is controlled according to the phase-cut input voltage of the thyristor dimmer 40, which ensures that the current ripple of the LED light string can be quite small when the thyristor is phase-cut to a small angle, and the LED flicker caused by the phase-cutting wave of the thyristor itself can be optimized.

In accordance with an embodiment of the present application, a constant-current drive device may also be provided, which includes the constant-current drive circuit described in any one of the above embodiments.

In accordance with an embodiment of the present application, a lamp may also be provided. The lamp includes: a light source load, and the constant-current drive circuit according to any one of the above embodiments. The constant-current drive circuit is connected to the light source load.

It can be clearly understood for those skilled in the art that, for the convenience and simplicity of description, the division of the above-mentioned functional units and modules are used only as examples for illustration. In practical applications, the above-mentioned functions can be allocated to different functional units or modules according to actual needs, that is, the internal structure of the device may be divided into different functional units or modules to complete all or part of the functions described above. Each functional unit and module in the embodiments may be integrated in one processing unit, or each unit may exist physically alone, or two or more units may be integrated into one processing unit. The above-mentioned integrated units may be implemented in the form of hardware, or may be implemented in the form of software functional units. In addition, the specific names of the functional units and modules are used only for the convenience of distinguishing from each other, and are not intended to limit the protection scope of the present application. For the specific working processes of the units and modules in the above-mentioned system, reference may be made to the corresponding processes in the foregoing method embodiments, which will not be repeated here.

In the foregoing embodiments, description of each embodiment has its own emphasis. For parts that are not described or described in detail in a certain embodiment, reference may be made to the relevant descriptions of other embodiments.

The units described as separate components may or may not be physically separated, and components displayed as units may or may not be physical units, which may be located in one place, or may be distributed to multiple network units. Some or all of the units may be selected according to actual needs to achieve the objectives of the solutions in the embodiments.

In addition, each functional unit in each embodiment of the present application may be integrated into one processing unit, or each unit may exist physically alone, or two or more units may be integrated into one unit. The above-mentioned integrated units may be implemented in the form of hardware, or may be implemented in the form of software functional units.

The above-mentioned embodiments are used only to illustrate the solutions of the present application rather than limitations. Although the present application has been described in detail with reference to the above-mentioned embodiments, those of ordinary skill in the art would understand that modifications may still be made to the solutions in the above-mentioned embodiments, or some features in the embodiments may be equivalently replaced. These modifications or replacements do not deviate from the essence and the spirit of the scope of the solutions in the embodiments of the present application, and should all be included within the protection scope of the present application.

What is claimed is:

1. A constant-current drive circuit, comprising:

a peak-voltage sample and hold module, configured to collect a voltage at an input end to generate an input-voltage sampling signal, and obtain a hold voltage at a current moment, according to an average of a peak voltage of the input-voltage sampling signal and a hold voltage at a previous moment, as a voltage value of an output voltage signal;

a voltage-controlled current source module, connected to the peak-voltage sample and hold module, and configured to receive the output voltage signal, and generate a current signal according to the output voltage signal and a preset second threshold voltage; and a constant-current threshold control module, connected to the voltage-controlled current source module, and configured to mirror the current signal according to a proportional coefficient to generate a mirrored current signal, and adjust a constant-current threshold according to the mirrored current signal, to maintain an operation current flowing through a load a constant current.

2. The constant-current drive circuit according to claim 1, wherein the peak-voltage sample and hold module comprises:

an input-voltage sampling unit, configured to sample a voltage signal at the input end to generate the input-voltage sampling signal;

a single-pulse generating unit, connected to the input-voltage sampling unit, and configured to generate a first serial single-pulse signal and a second serial single-pulse signal when a voltage value of the input-voltage sampling signal is greater than a first threshold voltage, wherein the second serial single-pulse signal is generated after the first serial single-pulse signal;

a sample-voltage averaging unit, connected to the input-voltage sampling unit and the single-pulse generating unit, and configured to collect the peak voltage of the input-voltage sampling signal, average the hold voltage at the previous moment with the peak voltage, during a duration of the first serial single-pulse signal, and update an averaged voltage to the hold voltage at the current moment as the voltage value of the output voltage signal.

3. The constant-current drive circuit according to claim 2, wherein the input-voltage sampling unit comprises: a first resistor and a second resistor; and wherein a first end of the first resistor is connected to the input end; a second end of the first resistor and a first end of the second resistor are connected in common to a peak voltage sampling unit; and a second end of the second resistor is grounded.

4. The constant-current drive circuit according to claim 2, wherein the single-pulse generating unit comprises: a single pulse generator and a first operational amplifier; and wherein a non-inverting input end of the first operational amplifier is connected to the input-voltage sampling unit; an inverting input end of the first operational amplifier is connectable to a first threshold voltage source; an output end of the first operational amplifier is connected to the single pulse generator; and a first output end and a second output end of the single pulse generator are both connected to the sample-voltage averaging unit.

5. The constant-current drive circuit according to claim 2, wherein the sample-voltage averaging unit is further configured to collect an average voltage of the input-voltage sampling signal, and update the average voltage of the current input-voltage sampling signal to the hold voltage at the current moment, or update the peak voltage of the current input-voltage sampling signal to the hold voltage at the current moment.

6. The constant-current drive circuit according to claim 2, wherein the sample-voltage averaging unit comprises: a second operational amplifier, a first switch, a first capacitor, a second switch, a third switch, a fourth switch, a fifth switch, a second capacitor and a resetter;

wherein a non-inverting input end of the second operational amplifier and a first end of the first switch are connected in common to the input-voltage sampling unit; an inverting input end of the second operational amplifier and a second end of the first switch, a first end of the first capacitor, a first end of the second switch and a first end of the third switch are connected in common; a second end of the first capacitor is grounded; and an output end of the second operational amplifier, a control end of the first switch and a first end of the fourth switch are connected in common; and wherein a control end of the second switch is connected to a first output end of the single-pulse generating unit; a second end of the third switch is grounded; a control end of the third switch and a control end of the fourth switch are connected in common to a second output end of the single-pulse generating unit; a second end of the fourth switch is grounded; a second end of the second switch, a first end of the fifth switch, and a first end of the second capacitor are connected in common to the voltage-controlled current source module; a second end of the second capacitor is grounded; a second end of the fifth switch is grounded, and a control end of the fifth switch is connected to the resetter.

7. The constant-current drive circuit according to claim 1, wherein the voltage-controlled current source module comprises: a third operational amplifier, a fourth operational amplifier, a sixth switch and a third resistor; and wherein a first end of the sixth switch is connected to the constant-current threshold control module; a non-inverting input end of the third operational amplifier is connectable to a second threshold voltage source; an inverting input end of the third operational amplifier, a second end of the sixth switch and a first end of the third resistor are connected in common; a control end of the sixth switch is connected to an output end of the third operational amplifier; a non-inverting input end of the fourth operational amplifier is connected to the peak-voltage sample and hold module; and an inverting input end of the fourth operational amplifier and an output end of the fourth operational amplifier are connected in common to a second end of the third resistor.

8. The constant-current drive circuit according to claim 1, wherein the constant-current threshold control module comprises:

a current mirror unit, connected to the voltage-controlled current source module, and configured to perform a mirror amplification on the current signal to generate the mirrored current signal; and an operation-current adjustment unit, connected to the current mirroring unit, and configured to adjust the constant-current threshold according to the mirrored current signal, so as to maintain the operation current flowing through the load a constant current.

9. A constant-current drive device, comprising:

a constant-current drive circuit, and the constant-current drive circuit comprising:

a peak-voltage sample and hold module, configured to collect a voltage at an input end to generate an input-voltage sampling signal, and obtain a hold voltage at a current moment, according to an average of a peak voltage of the input-voltage sampling signal and a hold voltage at a previous moment, as a voltage value of an output voltage signal;

a voltage-controlled current source module, connected to the peak-voltage sample and hold module, and configured to receive the output voltage signal, and generate a current signal according to the output voltage signal and a preset second threshold voltage; and a constant-current threshold control module, connected to the voltage-controlled current source module, and configured to mirror the current signal according to a proportional coefficient to generate a mirrored current signal, and adjust a constant-current threshold according to the mirrored current signal, to maintain an operation current flowing through a load a constant current.

10. A lamp, comprising:

a light source load; and a constant-current drive circuit, wherein the constant-current drive circuit is connected to the light source load, and comprises:

a peak-voltage sample and hold module, configured to collect a voltage at an input end to generate an input-voltage sampling signal, and obtain a hold voltage at a current moment, according to an average of a peak voltage of the input-voltage sampling signal and a hold voltage at a previous moment, as a voltage value of an output voltage signal;

a voltage-controlled current source module, connected to the peak-voltage sample and hold module, and configured to receive the output voltage signal, and generate a current signal according to the output voltage signal and a preset second threshold voltage; and a constant-current threshold control module, connected to the voltage-controlled current source module, and configured to mirror the current signal according to a proportional coefficient to generate a mirrored current signal, and adjust a constant-current threshold according to the mirrored current signal, to maintain an operation current flowing through a load a constant current.

11. The constant-current drive device according to claim 9, wherein the peak-voltage sample and hold module comprises:

an input-voltage sampling unit, configured to sample a voltage signal at the input end to generate the input-voltage sampling signal;

a single-pulse generating unit, connected to the input-voltage sampling unit, and configured to generate a first serial single-pulse signal and a second serial single-pulse signal when a voltage value of the input-voltage sampling signal is greater than a first threshold voltage, wherein the second serial single-pulse signal is generated after the first serial single-pulse signal;

a sample-voltage averaging unit, connected to the input-voltage sampling unit and the single-pulse generating unit, and configured to collect the peak voltage of the input-voltage sampling signal, average the hold voltage at the previous moment with the peak voltage, during a duration of the first serial single-pulse signal, and update an averaged voltage to the hold voltage at the current moment as the voltage value of the output voltage signal.

12. The constant-current drive device according to claim 11, wherein the input-voltage sampling unit comprises: a first resistor and a second resistor; and wherein a first end of the first resistor is connected to the input end; a second end of the first resistor and a first end of the second resistor are connected in common to a peak voltage sampling unit; and a second end of the second resistor is grounded.

13. The constant-current drive device according to claim 11, wherein the single-pulse generating unit comprises: a single pulse generator and a first operational amplifier; and wherein a non-inverting input end of the first operational amplifier is connected to the input-voltage sampling unit; an inverting input end of the first operational amplifier is connectable to a first threshold voltage source; an output end of the first operational amplifier is connected to the single pulse generator; and a first output end and a second output end of the single pulse generator are both connected to the sample-voltage averaging unit.

14. The constant-current drive device according to claim 11, wherein the sample-voltage averaging unit is further configured to collect an average voltage of the input-voltage sampling signal, and update the average voltage of the current input-voltage sampling signal to the hold voltage at the current moment, or update the peak voltage of the current input-voltage sampling signal to the hold voltage at the current moment.

15. The constant-current drive device according to claim 11, wherein the sample-voltage averaging unit comprises: a second operational amplifier, a first switch, a first capacitor, a second switch, a third switch, a fourth switch, a fifth switch, a second capacitor and a resetter;

wherein a non-inverting input end of the second operational amplifier and a first end of the first switch are connected in common to the input-voltage sampling unit; an inverting input end of the second operational amplifier and a second end of the first switch, a first end of the first capacitor, a first end of the second switch and a first end of the third switch are connected in common; a second end of the first capacitor is grounded; and an output end of the second operational amplifier, a control end of the first switch and a first end of the fourth switch are connected in common; and wherein a control end of the second switch is connected to a first output end of the single-pulse generating unit; a second end of the third switch is grounded; a control end of the third switch and a control end of the fourth switch are connected in common to a second output end of the single-pulse generating unit; a second end of the fourth switch is grounded; a second end of the second switch, a first end of the fifth switch, and a first end of the second capacitor are connected in common to the voltage-controlled current source module; a second end of the second capacitor is grounded; a second end of the fifth switch is grounded, and a control end of the fifth switch is connected to the resetter.

16. The constant-current drive device according to claim 9, wherein the voltage-controlled current source module comprises: a third operational amplifier, a fourth operational amplifier, a sixth switch and a third resistor; and wherein a first end of the sixth switch is connected to the constant-current threshold control module; a non-inverting input end of the third operational amplifier is connectable to a second threshold voltage source; an inverting input end of the third operational amplifier, a second end of the sixth switch and a first end of the third resistor are connected in common; a control end of the sixth switch is connected to an output end of the third operational amplifier; a non-inverting input end of the fourth operational amplifier is connected to the peak-voltage sample and hold module; and an inverting input end of the fourth operational amplifier and an output end of the fourth operational amplifier are connected in common to a second end of the third resistor.

17. The constant-current drive device according to claim 9, wherein the constant-current threshold control module comprises:

a current mirror unit, connected to the voltage-controlled current source module, and configured to perform a mirror amplification on the current signal to generate the mirrored current signal; and an operation-current adjustment unit, connected to the current mirroring unit, and configured to adjust the constant-current threshold according to the mirrored current signal, so as to maintain the operation current flowing through the load a constant current.

* * * * *